US007165673B2

(12) United States Patent
Marks

(10) Patent No.: US 7,165,673 B2
(45) Date of Patent: Jan. 23, 2007

(54) FIREARM CLEANING KIT CASE

(75) Inventor: Doreen Marks, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 167 days.

(21) Appl. No.: 10/654,158

(22) Filed: Sep. 3, 2003

(65) Prior Publication Data

US 2005/0045510 A1 Mar. 3, 2005

(51) Int. Cl.
*B65D 85/28* (2006.01)

(52) U.S. Cl. ..... 206/373; 206/473

(58) Field of Classification Search ..... 206/372, 206/373, 349, 376, 377, 378, 472, 473, 486; 190/109–111
See application file for complete search history.

(56) References Cited

U.S. PATENT DOCUMENTS 2,623,566 A * 12/1952 Kibler ..... 190/125
2,764,201 A * 9/1956 Whippo ..... 150/111
2,804,969 A * 9/1957 Barnett ..... 206/229
4,285,556 A * 8/1981 Loeffel ..... 312/244
4,386,642 A * 6/1983 Durbin ..... 190/110
4,793,508 A * 12/1988 Thompson ..... 220/533
4,852,293 A * 8/1989 Levine et al. ..... 43/54.1
4,887,751 A * 12/1989 Lehman ..... 224/579
4,901,464 A 2/1990 Banoun
D339,470 S 9/1993 Marks
5,337,505 A 8/1994 Brown et al.
5,687,819 A * 11/1997 Lodge et al. ..... 190/109
D400,702 S * 11/1998 McEvoy Sherman ..... D3/205
5,829,502 A * 11/1998 Distefano et al. ..... 150/113
5,845,780 A * 12/1998 Allen ..... 206/579
6,332,220 B1 * 12/2001 Mai ..... 2/51
6,634,473 B1 * 10/2003 Wagner ..... 190/110
6,655,529 B1 * 12/2003 Ho ..... 206/373
6,715,594 B1 * 4/2004 Milionta et al. ..... 190/110

* cited by examiner

*Primary Examiner*—Shian T. Luong
(74) *Attorney, Agent, or Firm*—Wall Marjama & Bilinski LLP

(57) ABSTRACT

A firearm cleaning kit includes a soft case which unzips along three sides so that the case is divided into two portions connected by a fabric fold line. Attached to the case at the fold line is a backing with a tool insert which has cavities for holding cleaning tools. The tool insert is optionally removably connected to a backing so that tool inserts with differently shaped cavities can be used. In one variation, an additional tool insert connects to the backing, leaving the backing sandwiched between the two tool inserts.

5 Claims, 5 Drawing Sheets

FIREARM CLEANING KIT CASE

FIELD OF THE INVENTION

This invention relates generally to the field of cases for cleaning kits, and more particularly to a cleaning kit case storing cleaning gear for a firearm.

BACKGROUND OF THE INVENTION

Cleaning the bore of a firearm regularly after use is an essential part of good firearm maintenance. Civilians who shoot and clean firearms typically store their cleaning materials in a case that, while portable, is not easily carried about the person. An example is an empty ammunition can, which because of its size, waterproof nature, and construction, is well suited for carrying firearm cleaning materials. Civilian firearms are typically cleaned at the end of the day in an indoor or camp environment.

Military personnel in field training or combat, on the other hand, have to be able to clean their weapons in the field, preferably immediately after shooting them so as to be ready for use at all times. A portable cleaning case is not sufficient to meet military needs for infantry combat personnel due to both size and weight constraints on field equipment. It has been estimated that a combat loaded military person carries between 60 and 80 pounds of equipment, including their firearm and ammunition. A need exists for a lightweight, compact, and easy to use firearm cleaning kit for military personnel.

SUMMARY OF THE INVENTION

Briefly stated, a firearm cleaning kit includes a soft case which unzips along three sides so that the case is divided into two portions connected by a fabric fold line. Attached to the case at the fold line is a backing with a tool insert which has cavities for holding cleaning tools. The tool insert is optionally removably connected to a backing so that tool inserts with differently shaped cavities can be used. In one variation, an additional tool insert connects to the backing, leaving the backing sandwiched between the two tool inserts.

According to an embodiment of the invention, a tool kit includes a case having first and second sides connected along a fold line; means for fastening the first and second sides together; and a tool insert connected to the case.

According to an embodiment of the invention, a tool insert for incorporation in a gun cleaning kit, the tool insert including a tool holding member having a plurality of predetermined shaped openings formed therein, wherein each of the predetermined shaped openings are adapted to securely retain respective gun cleaning tools therein.

DETAILED DESCRIPTION OF THE PREFERRED EMBODIMENT

Figure 1:
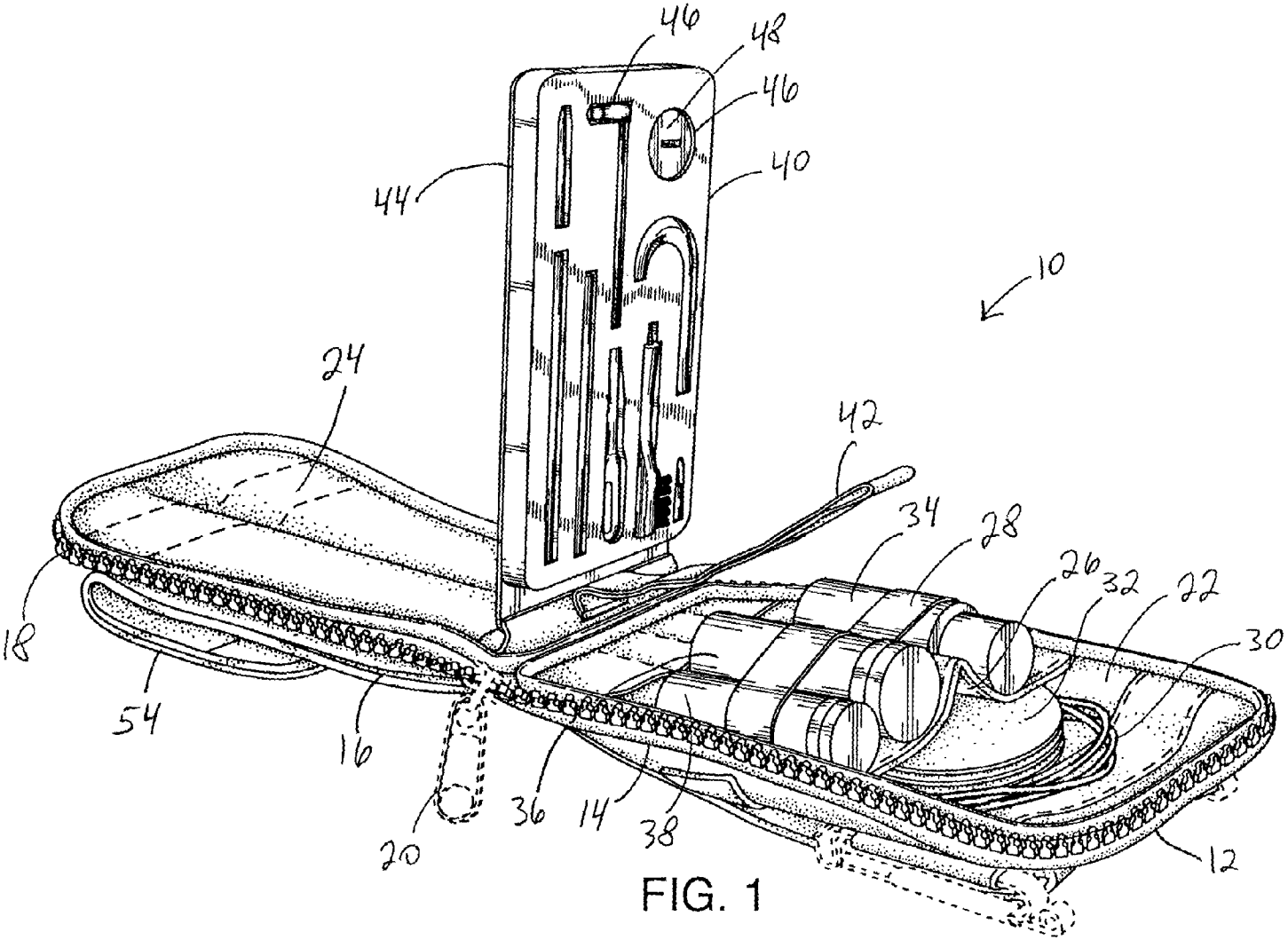
FIG. 1 shows a perspective view of a firearm cleaning kit case according to an embodiment of the invention.

Referring to FIG. 1, an embodiment of a firearm cleaning kit 10 is shown. An outer case 12 includes a first outer side 14 and a second outer side 16 which are closed together by zipper teeth 18 and a zipper pull 20. Although outer case 12 is shown as generally rectangular in shape, any shape that permits unzipping or unfastening a closed case to reveal two case sides flattened out on either side of a fold line works. VELCRO® or other fasteners such as snaps or ties can be used instead of a zipper, but the zipper is the preferred fastener due to its strength and ease of use. A first inner side 22 of kit 10 includes a pocket 26 which holds cleaning materials such as a flexible cleaning rod 30 and bore patches 32. An elastic strap 28 extending transversely across the outside of pocket 26 is preferably formed to hold additional cleaning materials such as bore solvent 34, a first bore brush 36, and a second bore brush 38. First and second bore brushes 36, 38 are any combination of brushes that suit the user. For example, if first bore brush 36 is a shotgun bore brush, second bore brush 38 could be a pistol/rifle bore brush. A second inner side 24 of kit 10 preferably does not contain any special cleaning materials so as to provide a readily accessible storage space for instructions or information printed on paper or plastic or the like.

A tool insert 40 is attached to kit 10 at a fold location separating first inner side 22 from second inner side 24. Insert 40 is preferably composed of foamed rubber and contains a plurality of cavities 46, each of which is formed to securely hold respective cleaning tools 48 therein. A strap 42 permits temporary storage of individual tools 48 while the user is cleaning the firearm. A rigid or semi-rigid backing 44 to which tool insert 40 is attached provides stiffening to insert 40 to prevent cleaning tools 48 from incidentally falling out of their cavities 46. The use of backing 44 also aids the manufacturing process by permitting cavities 46 to be formed as holes running completely through insert 40.

Figure 2:
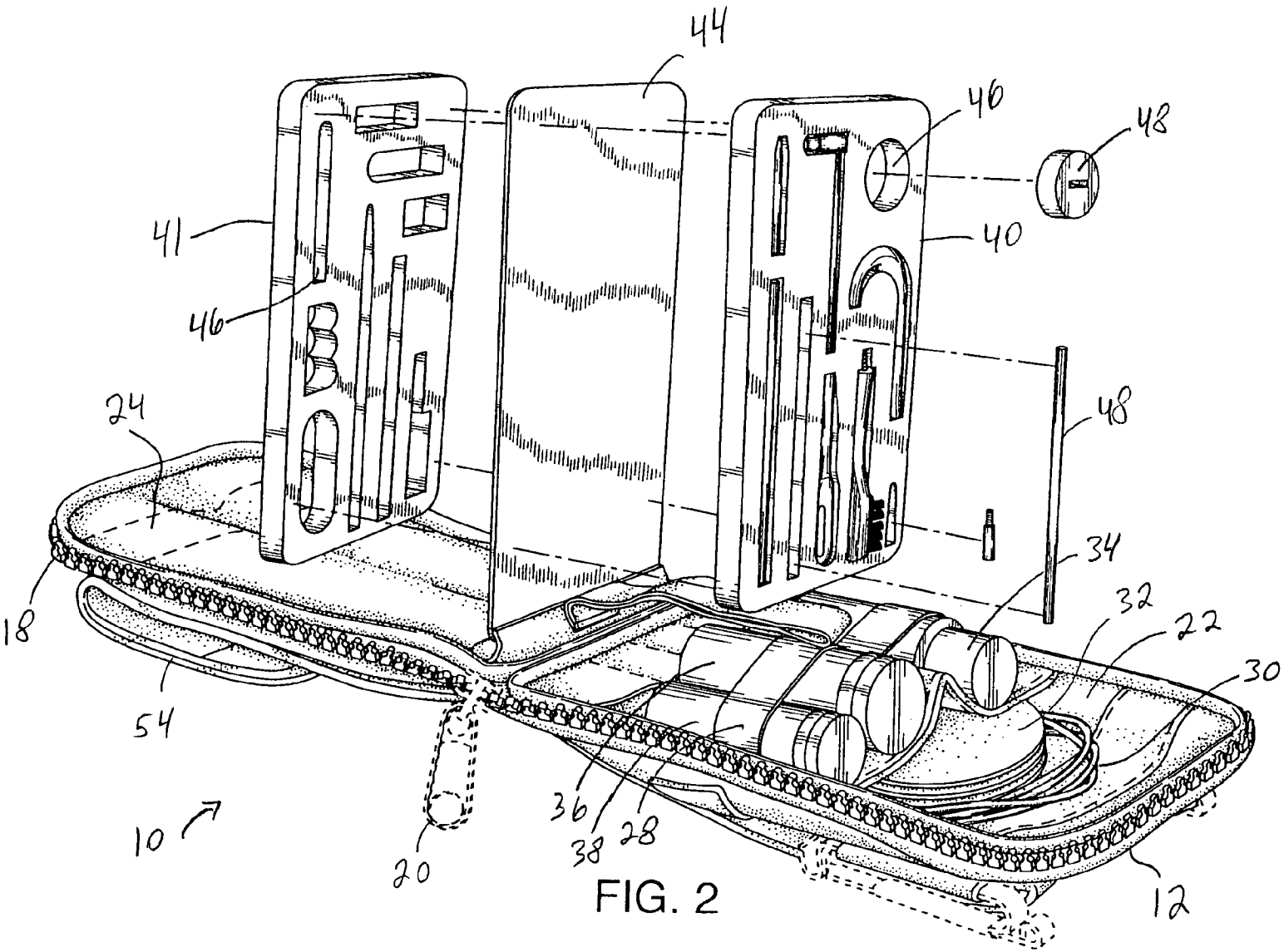
FIG. 2 shows a perspective view of a firearm cleaning kit case according to an embodiment of the invention.

Referring to FIG. 2, a second embodiment of kit 10 is shown in which a second tool insert 41 is attached on the opposite side of backing 44 from tool insert 40. Note that cavities 46 in tool insert 41 are preferably formed with shapes for cleaning tools 48 which are different from those shapes formed in tool insert 40, thus permitting the user the ability to clean a variety of firearms with kit 10.

Figure 3:
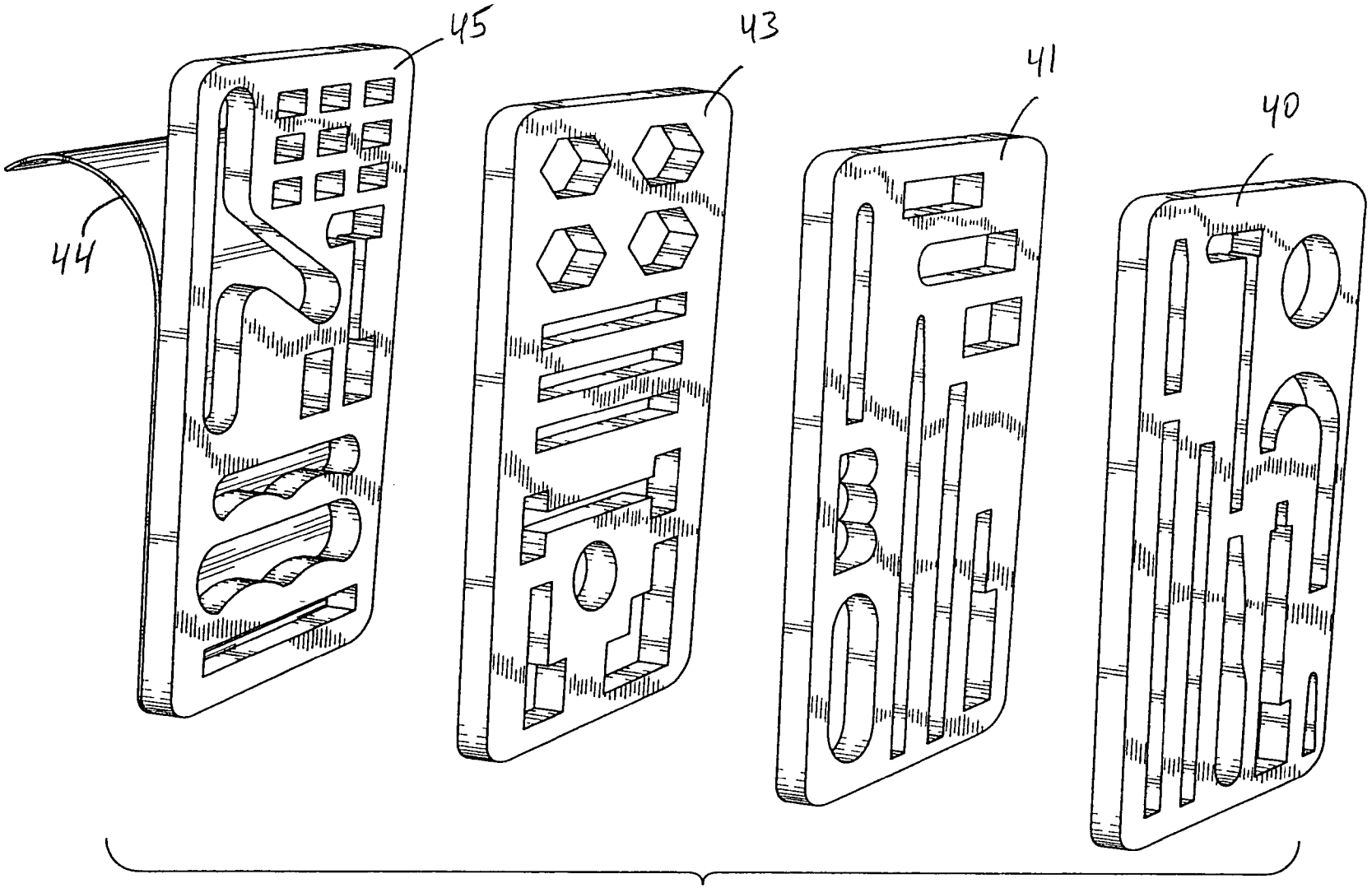
FIG. 3 shows a plurality of inserts usable with the embodiments of FIGS. 1 and 2.

Referring to FIG. 3, a variety of tool inserts 40, 41, 43, and 45 are shown. Note that inserts 40, 41, 43, and 45 all have differently shaped cavities to accommodate cleaning tools for different firearms. Backing 44 is shown being peeled away from tool insert 45 for illustrative purposes. Backing 44 is optionally removably attached to one tool insert (FIG. 1) or two tool inserts (FIG. 2) using a fastener such as VELCRO®, thus permitting the user to vary the combination of cleaning tools available within kit 10 for the user.

Figure 4:
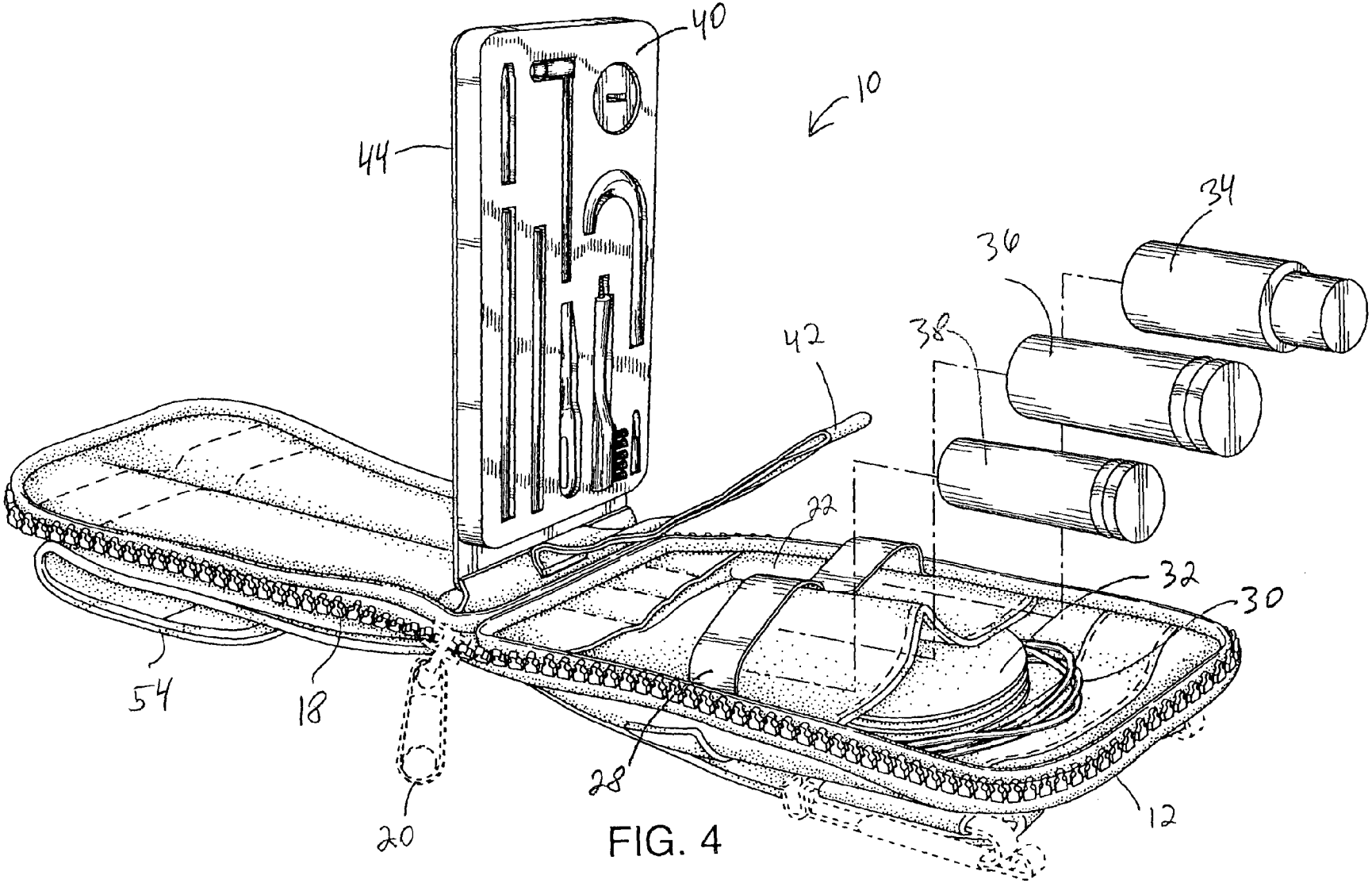
FIG. 4 shows an exploded perspective view of the embodiment of FIG. 1.

Referring to FIG. 4, kit 10 is shown with bore solvent 34 and bore brushes 36, 38 removed to show the structure of elastic strap 28 and how a portion of strap 28 is preferably stitched to inner side 22.

Figure 5:
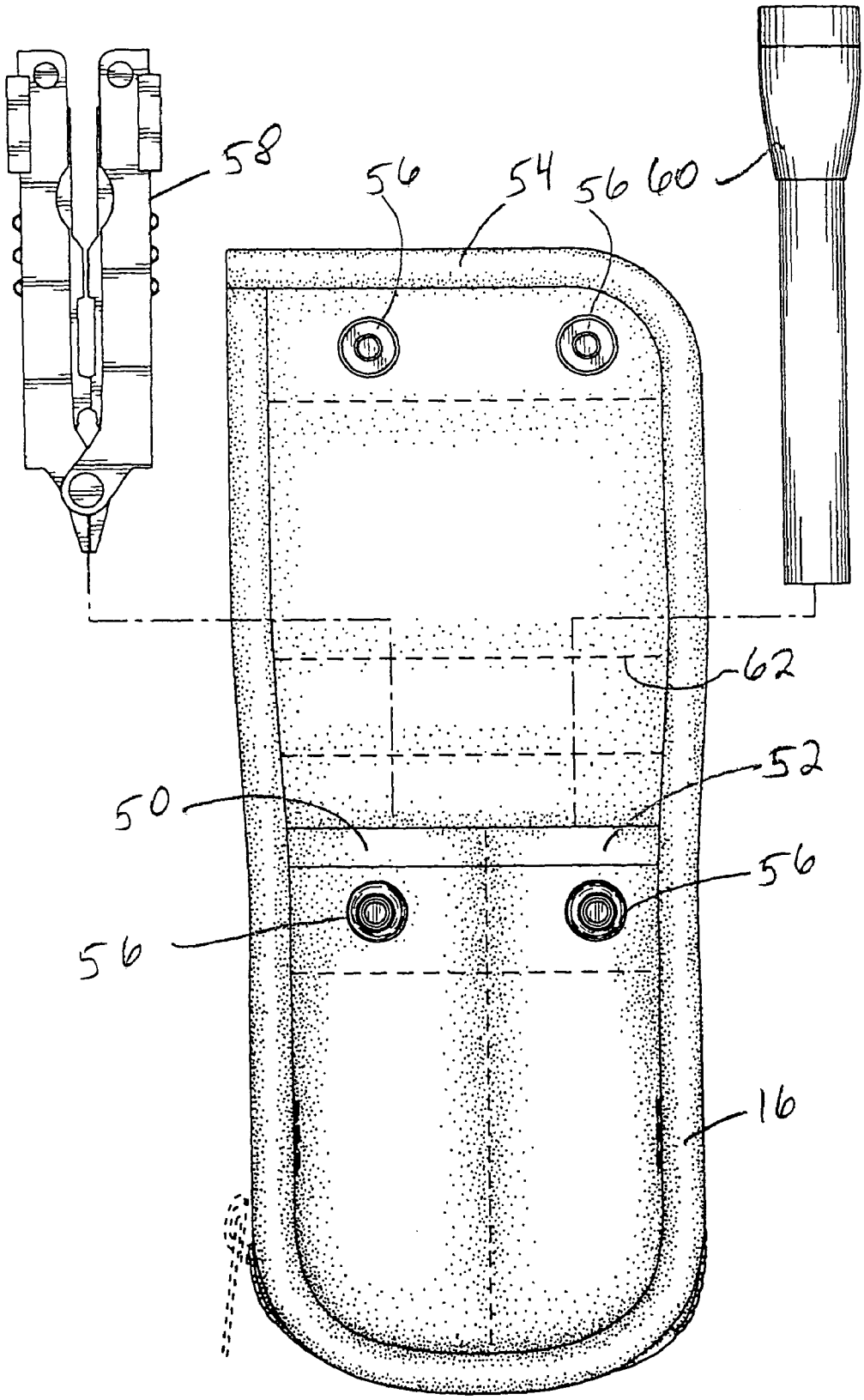
FIG. 5 shows a side view of the embodiments of FIGS. 1 and 2.

Referring to FIG. 5, outer side 16 is shown. A flashlight pouch 52 is formed on outer side 16 adjacent a multitool pouch 50. A flashlight 60 fits into pouch 52 while a multitool 58 fits into pouch 50. A flap 54 folds over a fold line 62 so that snaps 56 on an inside of flap 54 connect with snaps 56 on the outside of pouches 50 and 52.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A tool kit, comprising:

a plurality of firearm cleaning tools;

a case having first and second sides connected along a fold line, wherein at least a first tool holding area is defined on the first side of the case and wherein at least a second tool holding area is defined on the second side of the case, and wherein at least one of the first tool holding area and the second tool holding area is located outside of the case;

means for fastening said first and second sides of the case together;

a backing attached to said case at said fold line and having a first side facing said first side of said case and a second side facing said second side of said case;

a first tool holding insert having a first side and a second side, wherein the first side of the first tool holding insert is affixed to said first side of said backing, and wherein a plurality of tool-shaped cavities are defined through the first tool holding insert to span from the first side of the first tool holding insert to the second side of the first tool holding insert, and wherein at least one of the plurality of firearm cleaning tools is secured within at least one of the cavities of the first tool holding insert; and a second tool holding insert having a first side and a second side, wherein the first side of the second tool holding insert is affixed to the second side of said backing, and wherein a plurality of tool-shaped cavities are defined through the second tool holding insert to span from the first side of the second tool holding insert to the second side of the second tool holding insert, and wherein at least another of the plurality of firearm cleaning tools is secured within at least one of the cavities of the second tool holding insert.

2. A tool kit according to claim 1, wherein at least one of said first tool holding insert and said second tool holding insert is removably affixed to said backing.

3. A tool kit according to claim 1, wherein at least one of said first tool holding insert and second tool holding insert is permanently affixed to said backing.

4. A tool kit according to claim 1, wherein the first tool holding area is a pouch and the second tool holding area is a pocket.

5. A tool kit according to claim 4, wherein the pouch is located outside of the case and the pocket is located inside of the case.

* * * * *